US011602225B2

(12) United States Patent
Putman

(10) Patent No.: US 11,602,225 B2
(45) Date of Patent: Mar. 14, 2023

(54) KNIT SEAT BACK FOR AN OFFICE CHAIR

(71) Applicant: Haworth, Inc., Holland, MI (US)

(72) Inventor: Alexis M. Putman, Jenison, MI (US)

(73) Assignee: Haworth, Inc., Holland, MI (US)

( * ) Notice: Subject to any disclaimer, the term of this patent is extended or adjusted under 35 U.S.C. 154(b) by 118 days.

(21) Appl. No.: 16/912,179

(22) Filed: Jun. 25, 2020

(65) Prior Publication Data

US 2021/0401181 A1 Dec. 30, 2021

(51) Int. Cl.

| | |
|---|---|
| ***A47C 31/00*** | (2006.01) |
| ***A47C 31/02*** | (2006.01) |
| ***A47C 7/40*** | (2006.01) |
| ***D04B 1/22*** | (2006.01) |

(52) U.S. Cl.

CPC ..... *A47C 7/40* (2013.01); *A47C 31/006* (2013.01); *A47C 31/023* (2013.01); *D04B 1/22* (2013.01); *D10B 2505/08* (2013.01)

(58) Field of Classification Search

CPC ..... A47C 7/282; A47C 31/006; A47C 31/023
USPC ..... 297/452.56
See application file for complete search history.

(56) References Cited

U.S. PATENT DOCUMENTS 5,749,247 A 5/1998 Jeffcoat
6,231,125 B1 * 5/2001 Maeda ..... B60N 2/7011 297/452.56
6,302,487 B1 * 10/2001 Fujita ..... B60N 2/70 297/452.56
6,315,364 B1 * 11/2001 Fujita ..... D04B 21/12 297/452.56
6,644,070 B2 11/2003 Ikenaga et al.
6,932,432 B2 * 8/2005 Kawasaki ..... B60N 2/58 297/452.56
8,506,016 B2 * 8/2013 Mizobata ..... B60N 2/72 297/452.56
8,522,577 B2 9/2013 Huffa
8,708,418 B2 * 4/2014 Mizobata ..... B60N 2/7011 297/452.56
8,801,094 B2 * 8/2014 Nishiura ..... B60N 2/7011 297/452.56

(Continued)

*Primary Examiner* — Rodney B White
(74) *Attorney, Agent, or Firm* — Warner Norcross + Judd LLP

(57) ABSTRACT

A seat back for an office chair includes a knit material for extending over a structural frame. The knit material can be formed in a single knitting operation to include cushioning characteristics that vary across different regions of the knit material. The knit material may be a weft knit material having a first layer, a second layer, and a third layer, wherein the third layer is inlayed between the first and second layers and the inlay material is different from at least the first and second layers and provides a degree of cushioning between the first and second layers. The first and second layers are knit according to a predetermined pattern, the predetermined pattern determining crossing lines where the first and second layers cross one another and fix the third layer in position with respect to the first and second layers. The predetermined pattern is differentiated between regions of the back support, such that a first region of the back support has a higher density of crossing lines than a second region of the back support, the first region providing a different degree of cushioning than the second region.

8 Claims, 7 Drawing Sheets

(56) References Cited

U.S. PATENT DOCUMENTS

| | | | | |
|---|---|---|---|---|
| 8,967,726 | B2 * | 3/2015 | Schmitz | A47C 5/12 297/452.56 |
| 9,078,488 | B1 | 7/2015 | Meir et al. | |
| 10,233,574 | B2 | 3/2019 | Wan et al. | |
| 10,874,220 | B2 * | 12/2020 | Aldrich | B29C 70/56 |
| 2003/0193231 | A1 * | 10/2003 | Fujita | B60N 2/7094 297/452.56 |
| 2009/0051207 | A1 * | 2/2009 | Behrens | A47C 3/00 297/452.56 X |
| 2010/0213750 | A1 * | 8/2010 | Bogard | A47C 7/282 297/452.18 |
| 2013/0320721 | A1 * | 12/2013 | Cortellazzi | B60N 2/663 297/224 |
| 2016/0206102 | A1 | 7/2016 | Aldrich et al. | |
| 2017/0079444 | A1 * | 3/2017 | Blazar | A47C 31/006 |
| 2018/0245248 | A1 * | 8/2018 | Buffington | D03D 9/00 |
| 2019/0075889 | A1 | 3/2019 | Lang et al. | |
| 2019/0106037 | A1 | 4/2019 | Mankame et al. | |
| 2021/0368995 | A1 * | 12/2021 | Francescatto | |

* cited by examiner

KNIT SEAT BACK FOR AN OFFICE CHAIR

BACKGROUND OF THE INVENTION

The present invention relates to office-type seating, and more particularly to a knit seat back for office-type seating.

Conventional office-type chairs generally include a base, a pedestal or cylinder that extends upwardly from the base, a seat mounted on the base for supporting the user, and a chair back extending upwardly from the seat to provide a back support for the user. In most cases, the back support is capable of tilting or reclining with respect to the seat.

Modern office seat back supports commonly fall into two categories. In a first category, the back support has a central frame that extends upwardly from the seat. A fabric cover is fitted and attached over the central frame, and the fabric cover provides an aesthetically pleasing and comfortable surface for the user. In a second more recently developed category, the seat back includes a peripheral frame extending upwardly from the seat, and the peripheral frame forms a central opening. A fabric, often referred to as a suspended mesh, is held in tension over the central opening. The tension of the fabric provides a degree of flexibility and cushioning for the user and also forms the outer, user engaging surface.

In an attempt to simplify manufacturing processes and increase the aesthetic appearance of fabric covers for both seat back styles, manufacturers have turned to knit fabrics. Knitting may be generally classified as either weft knitting or warp knitting. In both weft knitting and warp knitting, one or more yarns are manipulated to form a plurality of intermeshed loops that define a variety of courses and wales. In weft knitting, the courses and wales are perpendicular to each other and may be formed from a single yarn or many yarns. In warp, knitting, however, the wales and courses run roughly parallel and one yarn is required for every wale.

The weft-knitting technique is often desirable because it allows manufacturing of fabric materials in predetermined, variable patterns, the yarn or the needle size being selected accordingly. Modern knitting machines enable a manufacturer to program the locations of various types of loops with multiple yarns across a one-piece knit material, resulting in a desired overall appearance with desired yarns positioned in predetermined locations on the final knit piece (such as a seat back). In some cases, multilayer knits are utilized, wherein an inlay yarn, which may be of a different material than the weft yarns, is placed in between the front and rear layers of the knit in one or more areas. Sometimes referred to as a "lofted" knit, the inlay yarn can have structural capabilities that provide a depth between the weft layers and create a degree of cushioning within the knit fabric.

SUMMARY OF THE INVENTION

The present invention provides a seat back for an office chair that includes a knit material for extending over a structural frame. The knit material can be formed in a single knitting operation to include cushioning characteristics that vary across different regions of the knit material.

In one embodiment, the seat back includes a back frame and a weft knit material attached to the back frame. The weft knit material and back frame together form a back support for a user. The knit material has a first layer formed from a first material, a second layer formed of a second material, and a third layer formed of a third material, wherein the third layer is inlayed between the first and second layers and the third material is different from at least the first and second materials. The first and second layers are knit according to a predetermined pattern, the predetermined pattern determining crossing lines where the first and second layers cross one another and fix the third layer in position with respect to the first and second layers. The predetermined pattern is differentiated between regions of the back support, such that a first region of the back support has a higher density of crossing lines (as described in more detail below) than a second region of the back support, the first region providing a different degree of cushioning than the second region.

In one embodiment, the first and second layers are the same material and the third layer is formed of a different material. The third layer may provide a degree of cushioning between the first and second layers, and in one embodiment, the third layer is a high loft polyester inlay yarn.

In one embodiment, the knit material is designed to provide a desired cushioning profile that provides support for the lower back and cushion for the upper back. More particularly, the first region may be a pelvic or lumbar region and the second region may be a thoracic region. In one embodiment, the seat back includes a third region that is a shoulder region, the third region having a lower density of crossing lines, and greater cushioning, than the second region. The predetermined pattern may have a variety of shapes and designs, however in one embodiment, the pattern includes formation of a hexagon pattern in the pelvic region, the hexagons are arranged in a hexagonal tessellation and are defined by the crossing lines, and the pattern gradually transitions to partially defined hexagons, and even less partially defined hexagons in the lumbar, thoracic and shoulder regions. In the shoulder regions, the crossing lines may simply appear as dimples in the knit material. The first region, second region and third region may each comprise about one-quarter of the height of the back support.

Figure 1:
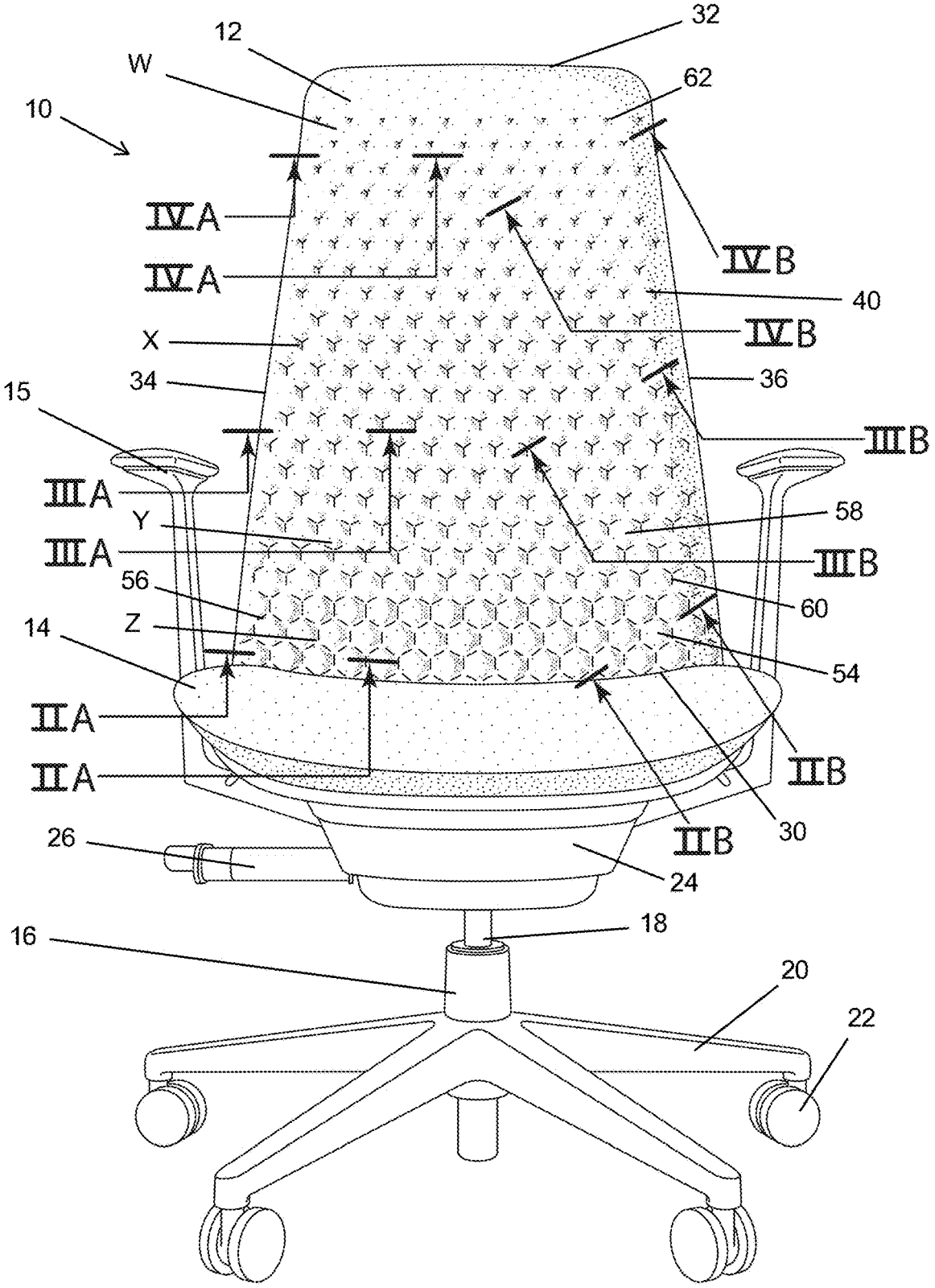
FIG. 1 is a front view of an office-type chair with a seat back support according to one embodiment of the present invention.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

An office-type chair 10 is shown in FIG. 1 with a back support 12 constructed in accordance with a current embodiment of the present invention. Although FIG. 1 illustrates the back support 12 as part of a complete chair 10 with a seat 14 and other support structure, this is only exemplary. The back support 12 may be generally used in connection with any chair or structure intended to provide seated back support for a user, but it particularly advantageous in the function of an office char in which a user requires a high level of comfort over a longer period of time.

FIG. 1 shows a view of an exemplary version of the chair 10. The office chair 10 generally includes a base 16, a seat 14, and optional armrests 15 extending upwardly from the seat 14. The seat 14 defines an upward facing support surface on which an occupant is supported. The base 16 may include a height adjustable pedestal 18 supported on a plurality of outwardly extending legs 20 to which casters 22 are pivotally mounted. Further, the chair 10 may include a recline mechanism 24 enabling recline of the back support 12 with respect to the seat 14 or the base 16. The recline mechanism may be provided with a tilt control mechanism for controlling the amount of tension required to recline the back support 12.

The back support 12 of the present invention defines a height extending from a base 30 at the bottom edge of the back support 12 to an upper edge 32. The back support also includes first and second lateral edges 34, 36 extending along opposing sides of the back support 12. The back support 12 can be described in terms of a series of regions extending from the upper edge 32 to the base 30. These regions include a thoracic region X (including shoulder region W), lumbar region Y, and pelvic region Z as illustrated in FIG. 1. The regions are divided approximately evenly along the height of the back support 12.

The back support 12 includes a support frame and a knit support material 40 supported on the frame. In the embodiment illustrated in FIG. 1, the knit support material 40 extends over an underlying rigid support frame (not shown) in the manner of a cover. The frame may be a solid core, or a peripheral frame defining an internal opening, or alternatively the frame including a combination flexible support frame and suspension material as disclosed in U.S. Pat. No. 10,182,657 to Beyer, owned by Haworth, Inc., the subject matter of which is hereby incorporated by reference.

Figure 7:
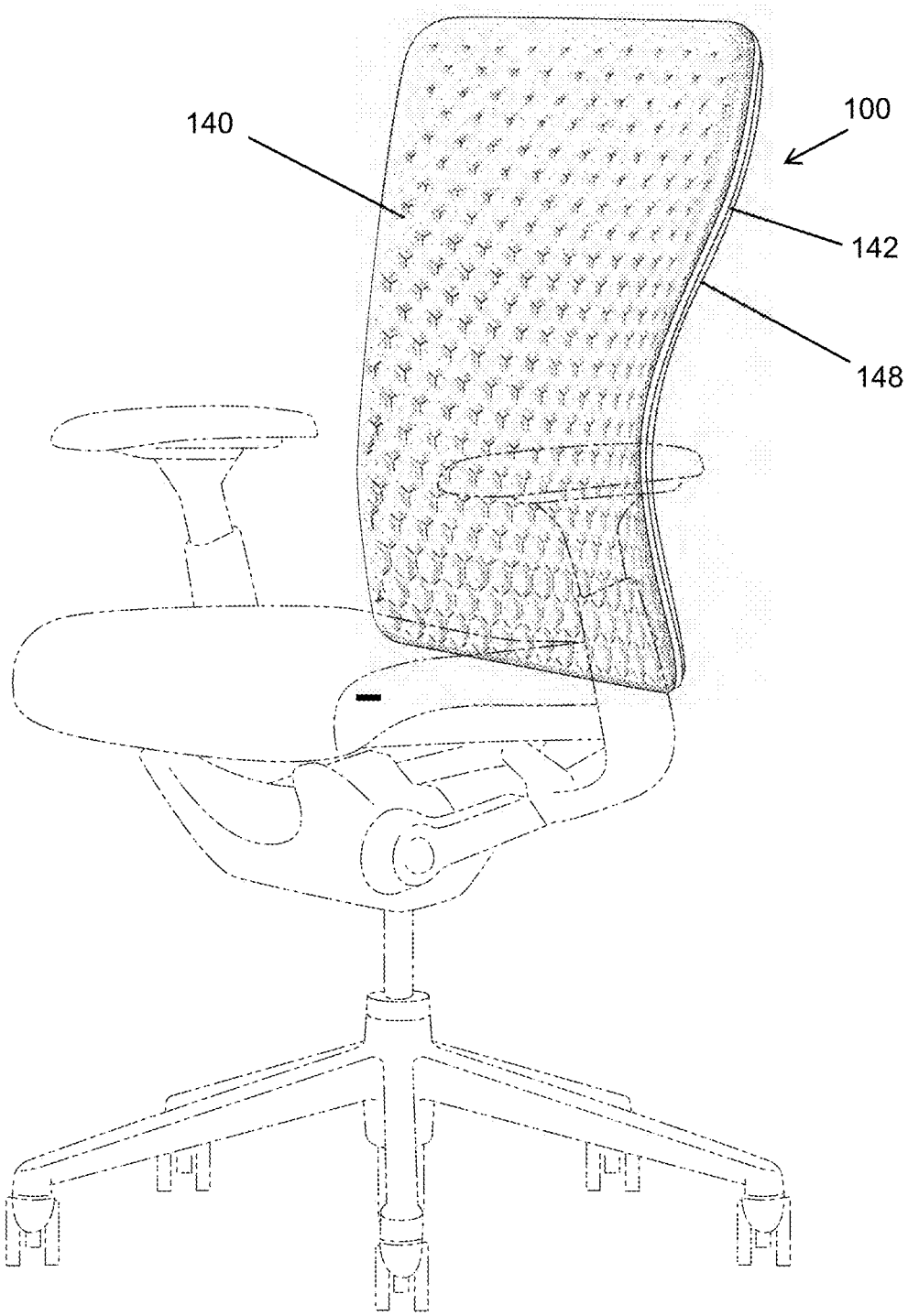
FIG. 7 is a perspective view of an office-type chair with a seat back support suspended in tension on a peripheral frame according to another embodiment of the present invention.
Figure 8:
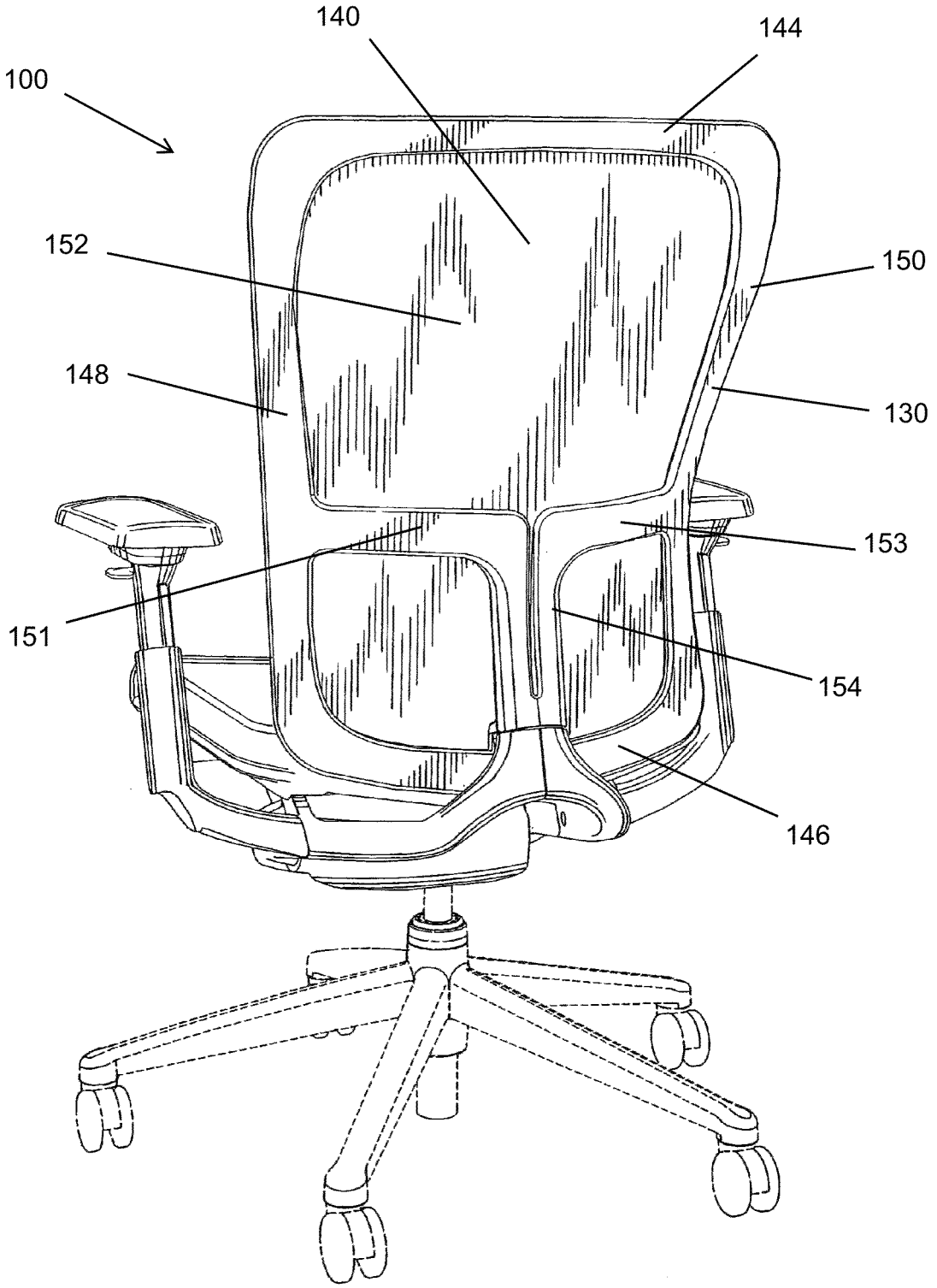
FIG. 8 is a rear perspective view of an office-type chair with a seat back support suspended in tension on a peripheral frame.

An office-type chair 100 with an alternative frame arrangement is shown in FIGS. 7 and 8. In this arrangement, the knit support material 140 is stretched and held in tension across a peripheral structural frame 142. Notably, the same general zoned inlay knit techniques can be applied to the knit support material 40 and the knit support material 140 with variations for each application as noted below. More particularly, the chair 100 includes a support frame 130 that includes a rigid peripheral frame including an upper frame portion 144, lower frame portion 146, and lateral side frame portions 148, 150 that cooperate to define a central opening 152. In the illustrated embodiment, the frame 142 further includes a central vertical frame portion 154 extending upwardly from a base 112 and spaced rearwardly from the lower frame portion 146. A pair of central horizontal frame portions 151, 153 extend outwardly from the central vertical frame portion 154 and connect with the lateral side frame portions 148, 150. In this embodiment, the knit support material 140 is attached to the peripheral frame 142 by one of a variety of fastening techniques. For example, a series of fasteners (not shown) may connect a portion of the knit material 140 to the frame 142, or a portion of the knit material 140 may be encapsulated and stretched by a portion of the frame 142. In one embodiment, the knit support material 140 may include yarn with characteristics that enable supporting the material 140 in tension, such as an elastomeric yarn or a heat shrinkable yarn.

Figure 5:
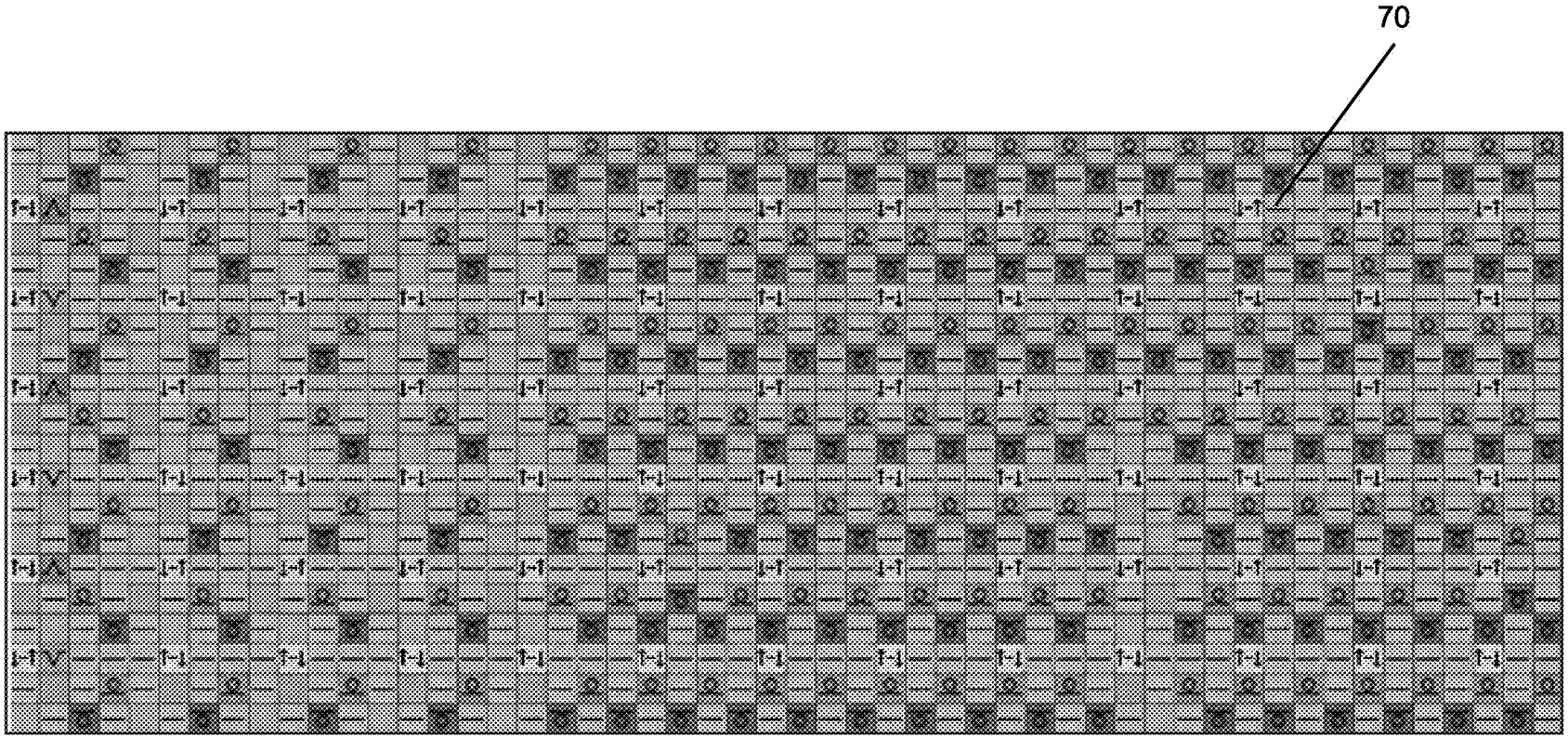
FIG. 5 is a view of a compressed pattern that defines a predetermined knitting program according to one embodiment of the present invention.
Figure 6:
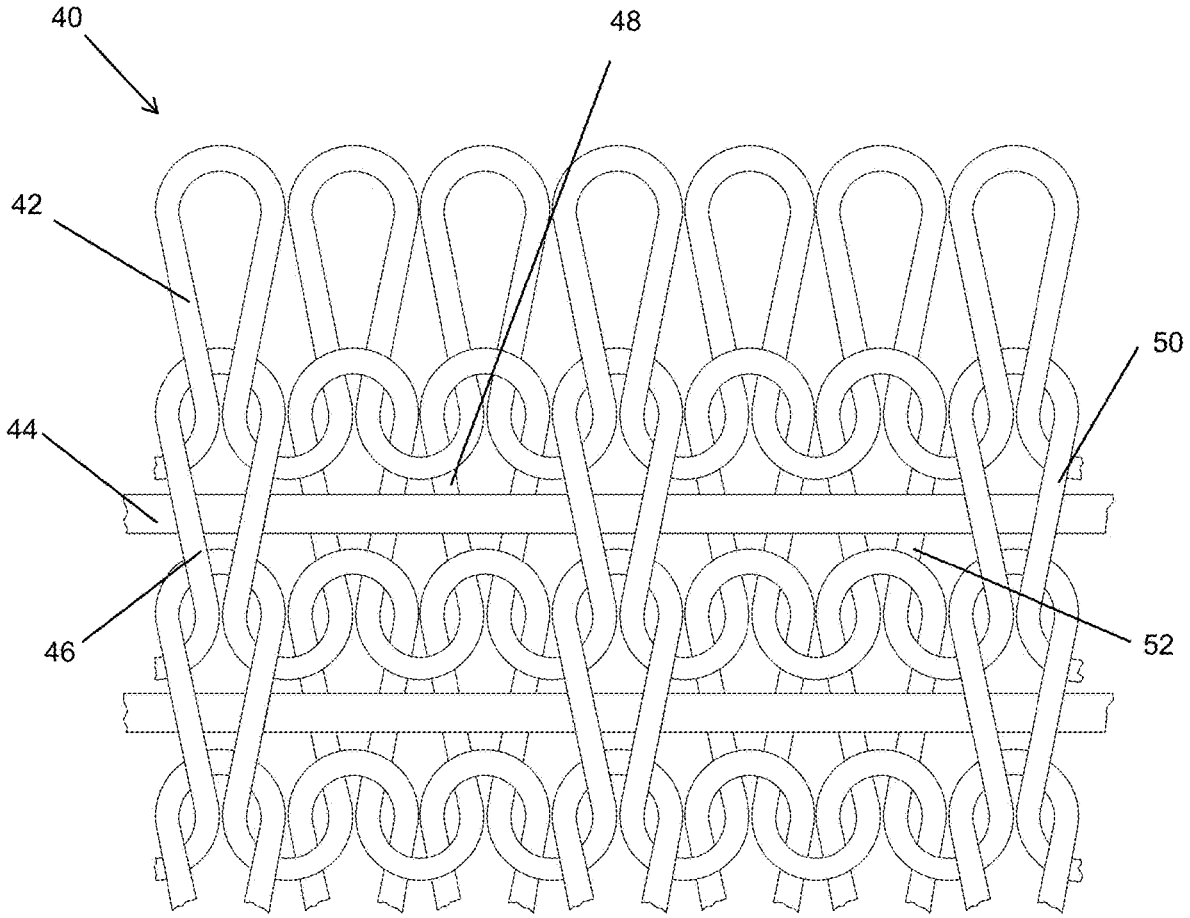
FIG. 6 is a plan view showing a knit structure according to one embodiment of the seat back material of the present invention.

The knit support material 40 extends over and is supported by the frame style selected for the particular chair. In one embodiment the knit support material 40 is formed by a weft knitting style with an inlay material, referred to herein as inlay weft knitting. Details of a weft knit material 40 are shown in FIGS. 2A-6. A close up, detailed example of one suitable configuration for a portion of the weft knitted material is depicted in FIG. 6. In this configuration, the knit material 40 includes a yarn 42 that forms a plurality of intermeshed loops defining multiple horizontal courses and vertical wales. An inlaid strand 44 (also referred to as an inlay yarn 44), or collection of strands, extend along one of the courses and alternates between being located (a) behind loops 46 formed from yarn 42 and forming a forward layer 50 of the knit material 40, and (b) in front of loops 48 formed from yarn 42 and forming a rear layer 52 of the knit material 40. In effect, the inlaid strand 44 passes through the structure formed by knit material 40. Although the yarn 42 forms each of the courses in this configuration, additional or alternative yarns may form one or more of the courses or may form a portion of one or more of the courses.

As shown in FIGS. 1-4B, the knit material 40 may be provided with a predetermined, programmed, knit pattern. In the current embodiment, variations in the knit pattern are utilized to create variations in the support and cushion characteristics of the knit material 40 as it extends across the various regions W-Z of the back support 12. The pattern provides both an enhanced aesthetic appearance as well as varied support and cushioning characteristics in a single knitting operation. FIG. 1 shows the forward layer 50 of the knit material 40 wherein the knit pattern can be viewed. In the illustrated embodiment, the pattern transitions along the height of the back support 12, such that it varies generally by the back support region W, X, Y, Z. The pattern forms a hexagonal tessellation including a series of interfitted hexagons 54 in the pelvic region Z. Each hexagon 54 is bounded by a line 56 formed by the yarn 42 crossing the knit beds during the knitting operation to tack the layers 50, 52 together and trap the inlay at those locations, hereinafter referred to as a "crossing line" 56. In other words, each crossing line is a location at which the front 50 and rear 52 layers cross each other and therefore trap the inlay yarn 44 in place. The crossing line 56 of a first hexagon 54 also forms a border of the immediately adjacent hexagons 54, such that the crossing line 56 of one hexagon can form borders with up to six (6) surrounding adjacent hexagons 54. Hexagons 54 near one of the edges 30, 34, 36 may have less than six adjacent hexagons 54 and this border less than six hexagons. In the illustrated embodiment, the hexagons 54 are arranged in rows extending across the width of the back support 12 from the lateral edge 34 to lateral edge 36. More particularly, in the illustrated embodiment the pattern includes visible three rows of hexagons 54 about the surface of seat 14.

In the lumbar region Y, and extending into the thoracic region X, the pattern transitions to a collection of interfitting, partially defined hexagons 58. These hexagons are "partially defined" because the stich lines 60 of these hexagons 58 do not completely surround each of the hexagons 58, and instead the crossing lines 60 form Y-shapes that outline three (3) corners and a portion of each side of the hexagon 58. The partially defined hexagons 58 extend horizontally in rows across the back support 12. Notably, in the illustrated embodiment, the amount of definition of the partially defined hexagons 58 transitions extending vertically upwardly along the back support 12. More particularly, the size of the Y-shaped crossing lines 60 decreases moving upwardly along the back support 12 from the lower portion of the lumbar region Y to the upper portion of the thoracic region X. In one embodiment, the Y-shaped crossing lines 60 have a uniform size across each of the rows of partially defined hexagons 58. The size of the Y-shaped crossing lines decreases as the rows progress upwardly on the back support 12, such that the size of the Y-shaped crossing lines 60 hear the upper portion of the thoracic region X are smaller than the size of the Y-shaped crossing lines 60 in the rows at the bottom of thoracic region X, and the Y-shaped crossing lines 60 at the bottom of the lumbar region Y are smaller than those at the top of the lumbar region Y. In one embodiment, the Y-shaped crossing lines 60 at the top of the thoracic region X and into the shoulder region W are substantially small such that they do not form hexagon shapes but rather appear as crossing points or dimples 62 in the knit material 40.

Figure 2A:
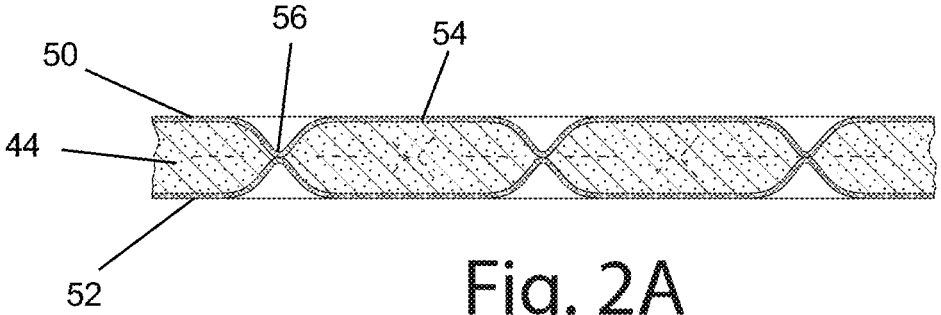
FIG. 2A is a cross sectional view of a portion of the seat back support material taken along line IIA in FIG. 1.
Figure 2B:
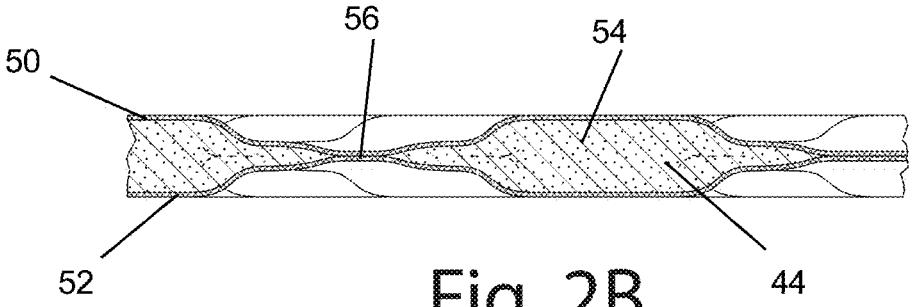
FIG. 2B is a cross sectional view of a portion of the seat back support material taking along line IIB in FIG. 1.
Figure 3A:
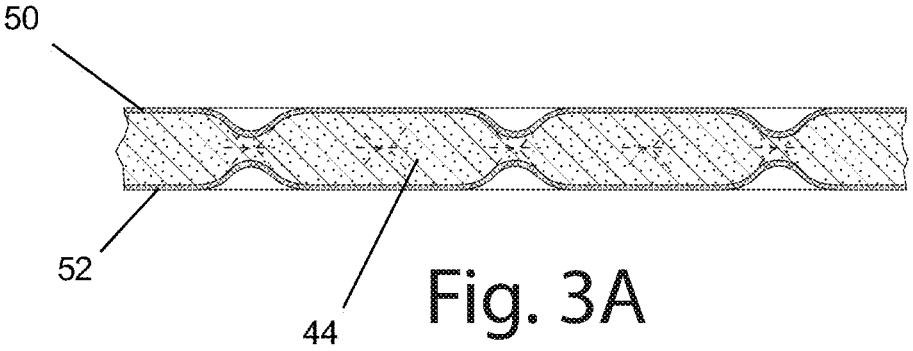
FIG. 3A is a cross sectional view of a portion of the seat back support material taken along line IIIA in FIG. 1.
Figure 3B:
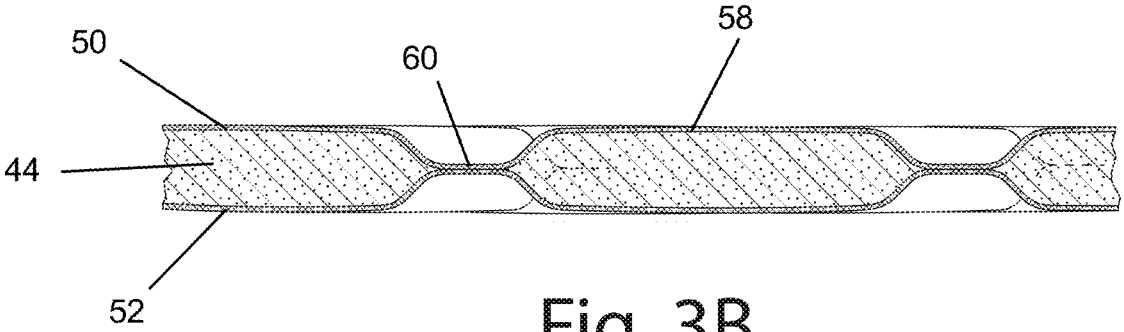
FIG. 3B is a cross sectional view of a portion of the seat back support material taking along line IIIB in FIG. 1.
Figure 4A:
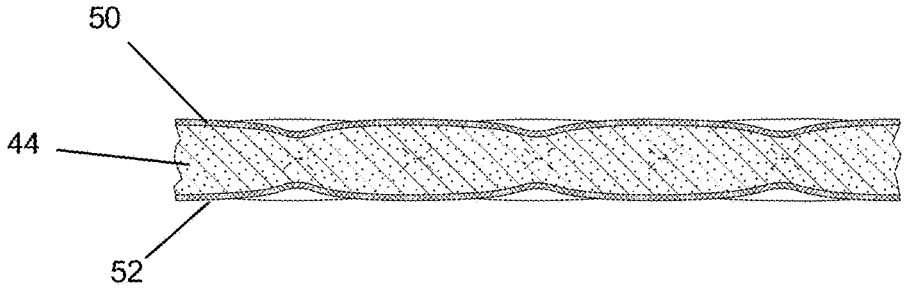
FIG. 4A is a cross sectional view of a portion of the seat back support material taken along line IVA in FIG. 1.
Figure 4B:
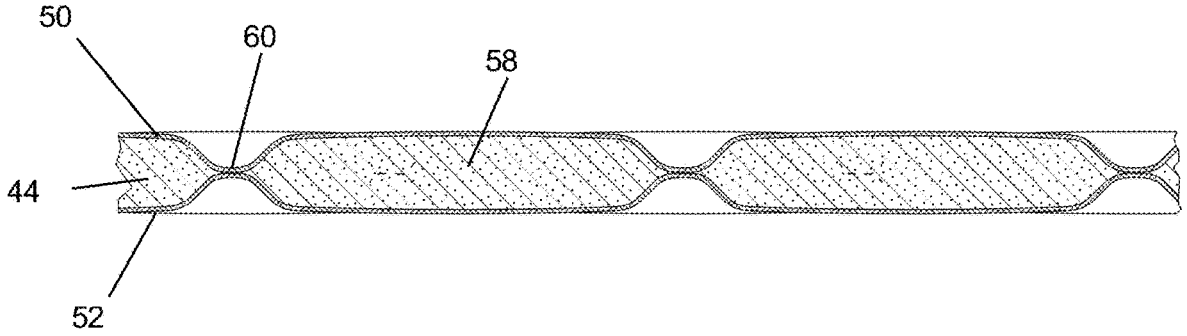
FIG. 4B is a cross sectional view of a portion of the seat back support material taking along line IVB in FIG. 1.

FIGS. 2A, 2B, 3A, 3B, 4A and 4B show cross sectional views of the knit material 40 taken at lines IIA, IIB, IIIA, IIIB, IVA and IVB respectively. Each of FIGS. 2A, 3A and 4A shows a horizontal cross sectional view of the knit material 40 at progressively higher locations on the back support 12, and each of FIGS. 2B, 3B and 4B show cross sectional views at progressively higher locations taken at an approximately 45 degree angle to horizontal. The horizontal cross sections of FIGS. 2A, 3A and 4A extend generally through a vertical midpoint of a selected row of hexagons 54 or partially defined hexagons 58. In each cross section of the knit material 40, the front knit layer 50, rear knit layer 52, and inlay yarn 44 are visible, and the thickness of the knit material 40, defined as the distance between the front 50 and rear 52 layers, can be seen. In locations where the cross sectional views extend through a crossing line 56 or 60, the yarns 42 of the upper layer 52 and lower layer 52 are looped with one another, pinching the inlay yarn 44. The crossing lines 56, 60 substantially flatten the inlay yarn 44 in those respective locations and the inlay yarn is trapped between the layers 50, 52 in the locations of the crossing lines 56, 60.

As noted above, the crossing lines 56, 60 also create the visible aesthetic pattern on the front surface 50 of the knit material 40.

Referring specifically to FIGS. 2A and 2B, it is seen that in the pelvic region Z the crossing lines 56 create the substantially full hexagons 54, resulting in the horizontal and angular cross sections in FIG. 2A and FIG. 2B wherein the crossing lines 56 completely pinch the inlay 44 at discrete intervals. FIGS. 3A and 3B show cross sectional views of the partially defined hexagons 58, 60. As shown in FIG. 3A, a cross section taken through the vertical midpoint of a row of partially defined hexagons 58, the crossing lines 60 do not completely define the edges of the partially defined hexagons 58 such that the cross sectional view in this location is adjacent to the Y-shaped crossing lines 60 and shows only a partial pinching of the inlay 44 between the front 50 and rear 52 layers. Similarly, FIG. 3B shows that the edges of the hexagons 58 are only partially defined. FIGS. 4A and 4B, cross sectional views located in the upper thoracic X and shoulder W regions, show the results of the crossing lines 60 that are smaller Y-shapes and more spaced apart. The inlay 44 is only slightly pinched in the horizontal cross section of FIG. 4A through the vertical midpoint of the row, and the "sides" of the partially defined hexagons 58 in this region are substantially shorter (approximately 50%) of the length of those shown in FIG. 3B.

The knit material 40 may incorporate various types of yarn that impart different desired properties to one of more areas of the seat back 12. In one embodiment, the knit material 40 is formed from one type of yarn 42. In another embodiment, however, one area of knit material 40 may be formed from a first type of yarn that imparts a first set of properties, and another area of knit material 40 may be formed from a second type of yarn that imparts a second set of properties. In this configuration, properties may vary throughout the knit material by selecting specific yarns for different areas of knit material. The properties that a particular type of yarn will impart to an area of knit material partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the one or more yarns 42 selected for knit material 40 may affect the properties of knit material 40. For example, a yarn 42 forming knit material 40 may be a monofilament yarn or a multifilament yarn. In an embodiment such as that shown in FIG. 1, wherein the knit material 40 is used in an application wherein it forms a cover extending over a structural frame, the yarn 42 of knit material 40 may include a multifilament yarn. And in an embodiment such as that shown in FIGS. 7 and 8, wherein the knit material 40 is stretched in tension and held by a perimeter frame 142, the yarn 42 for the knit material 140 may include a monofilament with a degree of elasticity, and in one embodiment may include a heat shrinkable yarn that can enables the knit material 40 to be attached to the perimeter frame and then heated to shrink the yarn 42 and create tension in the knit material 140. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of knit material 40. Accordingly, both the materials forming the yarn and other aspects of the yarn may be selected to impart a variety of properties to the knit material 40.

Inlay or "inlaid" strand 44, as noted above, extends through knit material 40 and passes between the various loops within knit material 40. More particularly, inlaid strand 44 is located within the knit structure of knit material 40, which may have the configuration of a double textile layer in the area of inlaid strand 44, such that the strand extends between layers 50 and 52 and is pinched and trapped between the layers at locations of the crossing lines 56, 60.

As with the yarns forming knit material 40, the configuration of inlaid strand 44 may also vary significantly. In addition to yarn, inlaid strand 44 may have the configurations of a filament (e.g., a monofilament), thread, rope, webbing or cable, for example. In comparison with the yarns forming knit material, the thickness of inlaid strand 44 may be greater, such that the inlaid strand provides a degree of cushioning between the layers 50, 52 of knit material 40. In one embodiment, the inlaid strand 44 is a lofted polyester, and in a more particular embodiment may be a high loft polyester batting. In another embodiment, the materials forming inlaid strand 44 may include any of the materials for the yarn within knit material 44, such as cotton, elastane, polyester, rayon, wool, and nylon. In one embodiment, suitable materials for inlaid strands 44 may also include a variety of engineering filaments, including electrically conductive filaments.

As a result of the zoned pattern of the knit material 40, the support and cushioning characteristics provided by the knit material 40 are different in the different regions W-Z. In general, a higher density or frequency of crossing lines 56, 60 that trap the inlay yarn 44 produces a tighter, less cushioned area of the back support 12. In the illustrated embodiment, the hexagons 54 in the pelvic region Z provide a tighter, less cushioned and more supportive region for the user due to the continuous trapping and pinching of the inlay yarn 44. Transitioning up the seat back 12, the knit material 40 increases in cushioning as the density of crossing lines 56, 60 decreases. The areas of partially defined hexagons 58 trap the inlay yarn 44 less than the hexagons 54, and thus increase the amount of loft and cushioning provided by the inlay yarn 44. As the size of the Y-shaped crossing lines 60 decrease moving up the seat back to the thoracic X and shoulder W regions, the inlay is trapped infrequently and thus provides a high degree of cushioning. A user seated in a chair 10 having this seat back 12 thus feels added support in the lower back region and added cushioning and comfort in the upper back region. These cushioning and support zones can be provided solely by the knit material 40, although optional additional cushioning or support layers can be provided as desired.

Although the seat back 12 is illustrated with a transitioning hexagon pattern, a variety of alternative patterns can be used to provide similar or alternative cushioning and support profiles. For example, the interfitting hexagon pattern may be replaced by a different interfitting pattern, such as squares, rectangles, diamonds, other polygons or irregular shapes. Like the hexagon pattern, these shapes may be arranged to provide less cushioning and greater support in the lower back region and greater cushioning in the upper back region, or they may be arranged to provide a different cushioning profile for a different user request or application.

In one embodiment, the knit material 40 is formed in a single knitting operation on a two-bed flat knitting machine. The knitting machine may be programmable, such that the knit pattern is pre-programmed into the knitting machine and the machine is operated to automatically knit the yarn 42 and inlay yarn 44 according to the program. FIG. 5 shows one example of a knit program 70, including a grid or "pack" that is programmed into an operating system of the knitting machine, wherein each square of the pack is uniquely associated with a specific needle operation for a particular location on the knit material 40, thus determining the precise location of each loop and each crossing line 58, 60. In another embodiment, the knit material 40 may be a 3D knit material 40 formed on a four bed knitting machine in a single knitting operation. This operation may include knitting, on flat, four bed knitting machine in a single knitting operation, a tubular knit fabric material 40. This operation enables formation of the knit material 40 having an exterior surface (such as forward surface 50), an interior surface (such as surface 52) defining an interior opening of the tubular knit material 40, a closed upper edge 32, an open bottom edge 30 opposite the closed upper edge 32, the open bottom edge 32 capable of receiving the structural back support frame of the back support 12 into the interior opening, and a forward portion and a rearward portion. The forward portion being the equivalent of knit material 40 and the rearward portion extending over the rear of the structural frame. The forward portion and the rearward portion each including a section of the exterior surface and the interior surface of the tubular fabric item, wherein the exterior surface of the forward portion includes a first visible pattern, such as the transitioning pattern of hexagons 54 and partially defined hexagons 58 shown in FIG. 1, and the exterior surface of the rearward portion (i.e., on the rear visible surface of the back support 12 not shown in FIG. 1) includes a second visible pattern, the first pattern and the second pattern independent of one another such that the second visible pattern could be the same transitioning hexagon pattern as shown on the forward surface 50 in FIG. 1, or a completely different pattern independent of the hexagon pattern.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A seat back for a chair, comprising:

a back frame; and a weft knit material attached to the back frame, the weft knit material and back frame together forming a back support for a user, the knit material having a first layer formed from a first material, a second layer formed of a second material, and a third layer formed of a third material;

wherein the third layer is inlayed between the first and second layers;

wherein the first and second layers are knit according to a predetermined pattern, the predetermined pattern determining crossing lines where the first and second layers cross one another and tack the third layer in position with respect to the first and second layers;

wherein the predetermined pattern is differentiated between regions of the back support, such that a first region of the back support has a higher density of crossing lines than a second region of the back support, the first region providing a different degree of cushioning than the second region;

wherein the first and second layers are the same material and the third layer is formed of a different material;

wherein the third layer is a high loft polyester inlay yarn;

wherein the first region is a lumbar region and the second region is a thoracic region;

wherein the seat back includes a third region that is a shoulder region, the third region having a lower density of crossing lines than the second region;

wherein the predetermined pattern includes formation of a hexagon pattern in the lumbar region, the hexagons interfitted with each other and defined by the crossing lines.

2. The seat back of claim 1 wherein the predetermined pattern includes the formation of a partially defined hexagon pattern in the thoracic region.

3. The seat back of claim 2 wherein the predetermined pattern includes the formation of a partially defined hexagon pattern in the shoulder region, wherein the partially defined hexagon pattern in the shoulder region is less defined than that of the thoracic region.

4. The seat back of claim 3 wherein the back support has an upper edge and a lower edge, and the back support defines a height between the upper and lower edges, wherein the first region, second region and third region each comprise about one-third of the height of the back support.

5. The seat back of claim 4 wherein the predetermined pattern gradually transitions from region to region.

6. An office-type chair, comprising:

a ground engaging base;

a height adjustable pedestal extending upwardly from the base;

a seat supported on the pedestal and forming a surface for supporting a user seated on the chair;

an upright back frame supported on one of the seat and the pedestal, the back frame extending upwardly from the seat;

a weft knit back support attached to the back frame and including a lower edge adjacent the seat, an upper edge opposite the lower edge, and a pair of lateral side edges, wherein the back support includes a forward layer facing the user, a rear layer opposite the forward layer, and an inlay between the forward layer and the rear layer;

wherein the forward layer and rear layer are knit with a predetermined pattern defined by cross points where the forward layer and rear layer cross each other and thereby pass through the inlay to hold the inlay in place with respect to the forward and rear layers;

wherein the back support includes a first region and a second region, the first and second regions each located in positions associated with a particular position on the back of a user, the first region having an increase density of cross points than the second region to provide differentiation in cushioning between the first and second regions;

wherein the density of cross points decreases from the lower edge toward the upper edge;

wherein the first and second layers are formed from a first material and the inlay is formed from a second material;

wherein the inlay is a polyester yarn;

wherein the predetermined pattern in the first region includes a series of adjacent generally closed shapes outlined by cross points;

wherein the predetermined pattern in the second region includes a series of partially closed shapes; and wherein the back support includes a third region including a series of dimples formed by the cross points.

7. The chair of claim 6 wherein the predetermined pattern gradually transitions from the generally closed shapes in the first region to the partially closed shapes in the second region to the dimples in the third region.

8. The chair of claim 7 wherein the predetermined pattern extends substantially from the first lateral edge to the second lateral edge in each of the regions.

* * * * *